US011300114B2

(12) United States Patent
Chen

(10) Patent No.: US 11,300,114 B2
(45) Date of Patent: Apr. 12, 2022

(54) AUTOMATIC E-LIQUID TRANSPORTATION SYSTEM AND METHOD OF ELECTRONIC CIGARETTE AS WELL AS PERISTALTIC PUMP

(71) Applicant: Zhenjiang Chen, Wanning (CN)

(72) Inventor: Zhenjiang Chen, Wanning (CN)

( * ) Notice: Subject to any disclaimer, the term of this patent is extended or adjusted under 35 U.S.C. 154(b) by 170 days.

(21) Appl. No.: 16/448,376

(22) Filed: Jun. 21, 2019

(65) Prior Publication Data

US 2020/0196678 A1 Jun. 25, 2020

(30) Foreign Application Priority Data

Dec. 24, 2018 (CN) ..... 201811583395.7
Dec. 24, 2018 (CN) ..... 201822169593.0

(51) Int. Cl.
*A24F 40/48* (2020.01)
*F04B 43/09* (2006.01)
*F04B 43/08* (2006.01)

(52) U.S. Cl.
CPC ..... *F04B 43/09* (2013.01); *F04B 43/082* (2013.01)

(58) Field of Classification Search
CPC ..... A24F 40/10; A24F 40/48; A24F 40/50; A24F 40/57; F04B 43/09
USPC ..... 131/328, 329
See application file for complete search history.

(56) References Cited

U.S. PATENT DOCUMENTS 8,511,318 B2 * 8/2013 Hon ..... A24F 40/40 131/273
2014/0190496 A1 * 7/2014 Wensley ..... A24B 15/167 131/273
2016/0374400 A1 * 12/2016 Monsees ..... A24F 40/51 131/329

* cited by examiner

*Primary Examiner* — Hae Moon Hyeon
(74) *Attorney, Agent, or Firm* — Bay State IP, LLC

(57) ABSTRACT

The present disclosure relates to an automatic e-liquid transportation system and method of electronic cigarette as well as a peristaltic pump. The system comprises a peristaltic pump and a control system, wherein the control system comprises a temperature detector, a servo motor controller and a master controller; the temperature detector is used for detecting a real-time atomization temperature of a heating part of an atomizer and transmitting the real-time atomization temperature data to the master controller; the master controller determines an e-liquid feeding quantity or an e-liquid withdrawing quantity according to the real-time atomization temperature; when the real-time atomization temperature is determined to be greater than a preset temperature threshold, the servo motor controller controls a motor of the peristaltic pump to rotate in the forward direction in order to feed an e-liquid according to the e-liquid feeding quantity.

8 Claims, 6 Drawing Sheets

AUTOMATIC E-LIQUID TRANSPORTATION SYSTEM AND METHOD OF ELECTRONIC CIGARETTE AS WELL AS PERISTALTIC PUMP

CROSS REFERENCE TO RELATED APPLICATION

This application takes priority from and claims the benefit of Chinese Patent Application No. 201811583395.7 filed on Dec. 24, 2018 and Chinese Patent Application No. 201822169593.0 filed on Dec. 24, 2018, the contents of which are herein incorporated by reference.

TECHNICAL FIELD

The present disclosure belongs to the technical field of electronic cigarettes, and specifically relates to an automatic e-liquid transportation system and method of electronic cigarette as well as a peristaltic pump.

BACKGROUND OF THE INVENTION

An electronic cigarette is a low-pressure micro-electronic atomizing device. In an atomization manner, the e-liquid is added to an atomizing part and then is heated to be atomized so as to form vapor, and the user inhales the vapor. When the electronic cigarette works, the e-liquid supplying process will directly influence the user experience.

Currently, the supply of the e-liquid in the electronic cigarette working process is usually achieved in the following two manners: a manually dropwise adding manner, wherein in this manner, the e-liquid should be added frequently, so that operations are tedious; and a manually extruding manner, wherein in this manner, the supply quantity of the e-liquid is inaccurate, for example, if the supply quantity of the e-liquid is insufficient, the real-time atomization temperature of the atomizer is over-high so that the atomizer is easy to be burnt, and if the supply quantity of the e-liquid is excessive, the e-liquid will be splashed or leaked, thereby causing bad taste and experience to the user.

SUMMARY OF THE INVENTION

An objective of the present disclosure is to provide an automatic e-liquid transportation system and method of electronic cigarette as well as a peristaltic pump in order to solve problems of tedious operations in the electronic cigarette e-liquid transportation process, bad taste, and e-liquid splashing or leaking in the prior art.

In order to achieve the above objective, the present disclosure adopts the following technical schemes.

In the first aspect, embodiments of the present disclosure provide an automatic e-liquid transportation system of electronic cigarette. The system comprises a peristaltic pump and a control system, wherein:

the control system comprises a temperature detector, a servo motor controller and a master controller;

the temperature detector is used for detecting a real-time atomization temperature of a heating part of an atomizer and transmitting the real-time atomization temperature data to the master controller;

the master controller determines an e-liquid feeding quantity or an e-liquid withdrawing quantity according to the real-time atomization temperature;

when the real-time atomization temperature is determined to be greater than a preset temperature threshold, the servo motor controller controls a motor of the peristaltic pump to rotate in the forward direction in order to feed an e-liquid according to the e-liquid feeding quantity; and when the real-time atomization temperature is determined to be smaller than the preset temperature threshold, the servo motor controller controls the motor of the peristaltic pump to rotate in the reverse direction in order to withdraw the e-liquid according to the e-liquid withdrawing quantity.

Furthermore, the when the real-time atomization temperature is determined to be greater than a preset temperature threshold, the servo motor controller controls a motor of the peristaltic pump to rotate in the forward direction in order to feed an e-liquid according to the e-liquid feeding quantity comprises:

when the real-time atomization temperature is determined to be greater than a preset temperature threshold, the servo motor controller controls a motor of the peristaltic pump to rotate in the forward direction at a first rotational speed in order to feed an e-liquid according to the e-liquid feeding quantity.

Furthermore, the when the real-time atomization temperature is determined to be smaller than the preset temperature threshold, the servo motor controller controls the motor of the peristaltic pump to rotate in the reverse direction in order to withdraw the e-liquid according to the e-liquid withdrawing quantity comprises:

when the real-time atomization temperature is determined to be smaller than the preset temperature threshold, the servo motor controller controls the motor of the peristaltic pump to rotate in the reverse direction at a second rotational speed in order to withdraw the e-liquid according to the e-liquid withdrawing quantity.

Furthermore, the system further comprises an e-liquid tank, wherein the e-liquid tank is separated from the heating part of the atomizer.

In the second aspect, embodiments of the present disclosure provide an automatic e-liquid transportation method of electronic cigarette, which is applied to the automatic e-liquid transportation system of electronic cigarette in the first aspect. The method comprises the steps:

acquiring a real-time atomization temperature of the heating part of the atomizer, and determining an e-liquid feeding quantity or an e-liquid withdrawing quantity according to the real-time atomization temperature;

judging whether the real-time atomization temperature is greater than a preset temperature threshold; if yes, controlling the motor of the peristaltic pump to rotate in the forward direction in order to feed the e-liquid according to the e-liquid feeding quantity;

if no, controlling the motor of the peristaltic pump to rotate in the reverse direction in order to withdraw the e-liquid according to the e-liquid withdrawing quantity.

Furthermore, the step of controlling the motor of the peristaltic pump to rotate in the forward direction in order to feed the e-liquid according to the e-liquid feeding quantity comprises:

controlling the motor of the peristaltic pump to rotate in the forward direction at a first rotational speed in order to feed an e-liquid according to the e-liquid feeding quantity.

Furthermore, the step of controlling the motor of the peristaltic pump to rotate in the reverse direction in order to withdraw the e-liquid according to the e-liquid withdrawing quantity comprises:

controlling the motor of the peristaltic pump to rotate in the reverse direction at a second rotational speed in order to withdraw the e-liquid according to the e-liquid withdrawing quantity.

Furthermore, the step of determining an e-liquid feeding quantity or an e-liquid withdrawing quantity according to the real-time atomization temperature comprises:

determining a target e-liquid quantity at the current real-time atomization temperature according to a corresponding relation of the atomization temperature and the e-liquid quantity; and comparing the current e-liquid quantity with the target e-liquid quantity so as to determining the e-liquid feeding quantity or the e-liquid withdrawing quantity.

In the third aspect, embodiments of the present disclosure provide a peristaltic pump. The peristaltic pump comprises a motor, a reduction gear, a pump head and a hose, wherein, the hose is fixed by a stator and a rotor, and the hose is used for connecting an e-liquid tank and an atomization part of the atomizer, wherein the stator is a pump case, and the rotor is rollers; and the motor increases the torque through the reduction gear to drive the pump head to run in order that the rollers in the pump head alternatively extrude the hose, thereby achieving e-liquid feeding and e-liquid withdrawing.

Furthermore, the number of the rollers may be one, two or three; correspondingly, when the number of the rollers is two, the two rollers are arranged in a manner that an included angle of 180 degrees is formed between the two rollers, and when the number of the rollers is three, the three rollers are arranged in a manner that an included angle of 120 degrees is formed between every two adjacent rollers.

Furthermore, the pump head and the motor are fixed by screws.

Furthermore, the pump head comprises a pump head upper cover, locating pins, a supporting seat and rollers.

Furthermore, the interiors of the rollers sleeve the locating pins, and through holes for allowing the insertion of the rollers are formed in the supporting seat.

Furthermore, the peristaltic pump further comprises a motor housing.

By adopting the above technical scheme, the present disclosure has the following technical effects: the real-time atomization temperature of the heating part of the atomizer is detected by the temperature detector in the control system, and according to the real-time atomization temperature, the master controller determines the e-liquid feeding quantity or the e-liquid withdrawing quantity, thereby improving the accuracy of the e-liquid supplying process; and the motor of the peristaltic pump is controlled to rotate in the forward direction or in the reverse direction by comparing the real-time atomization temperature with the preset real-time atomization temperature in order to achieve the e-liquid feeding or the e-liquid withdrawing, thereby achieving automatic control on the e-liquid feeding or e-liquid withdrawing process; and the e-liquid feeding quantity and the e-liquid withdrawing quantity are accurately controlled, so that the taste is ensured when the user uses the electronic cigarette, and the user experience is improved.

BRIEF DESCRIPTION OF THE DRAWINGS

To describe the technical schemes in the embodiments of the present disclosure or the prior art more clearly, the following briefly introduces the accompanying drawings required for describing the embodiments or the prior art. Apparently, the accompanying drawings in the following description show merely some embodiments in the present disclosure, and a person of ordinary skill in the art may still derive other drawings from these accompanying drawings without creative efforts.

DETAILED DESCRIPTION OF THE SEVERAL EMBODIMENTS

To make the objectives, technical schemes, and advantages of the present disclosure clearer, the following describes the technical schemes of the present disclosure in detail. Apparently, the described embodiments are merely a part rather than all of the embodiments of the present disclosure. All other embodiments obtained by a person of ordinary skill in the art based on the embodiments of the present disclosure without creative efforts shall fall within the protection scope of the present disclosure.

Embodiment 1

Figure 1:
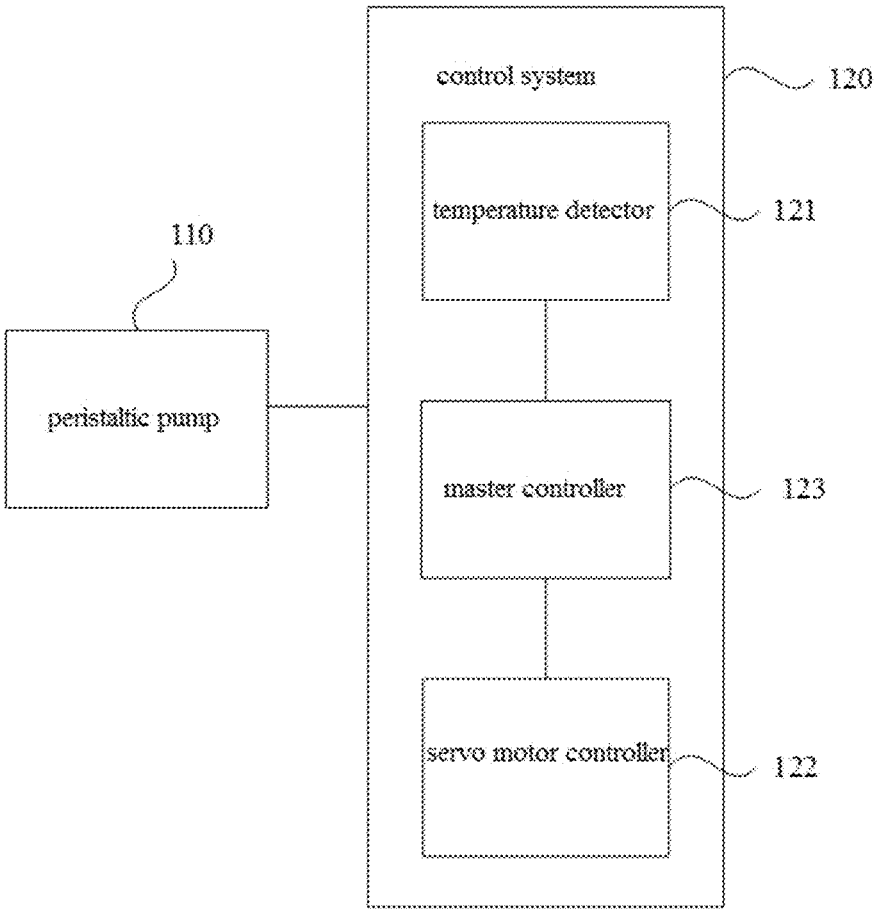
FIG. 1 is a schematic structural diagram of an automatic e-liquid transportation system of electronic cigarette, provided by embodiment 1 of the present disclosure.

FIG. 1 is a schematic structural diagram of an automatic e-liquid transportation system of electronic cigarette, provided by embodiment 1 of the present disclosure. Referring to FIG. 1, the system specifically may comprise a peristaltic pump 110 and a control system 120.

The control system 120 comprises a temperature detector 121, a servo motor controller 122 and a master controller 123, wherein the temperature detector 121 is used for detecting a real-time atomization temperature of a heating part of an atomizer 150 and transmitting the real-time atomization temperature data to the master controller 123; the master controller 123 determines an e-liquid feeding quantity or an e-liquid withdrawing quantity according to the real-time atomization temperature; when the real-time atomization temperature is determined to be greater than a preset temperature threshold, the servo motor controller 122 controls a motor of the peristaltic pump 110 to rotate in the forward direction in order to feed the e-liquid according to the e-liquid feeding quantity; and when the real-time atomization temperature is determined to be smaller than the preset temperature threshold, the servo motor controller 122 controls the motor of the peristaltic pump 110 to rotate in the reverse direction in order to withdraw the e-liquid according to the e-liquid withdrawing quantity. It should be noted that the servo motor controller 122 may be further configured in a servo system 140, which is not limited herein.

In the actual application process, an e-liquid supplying process controlled by the control system is as follows: the peristaltic pump transports the e-liquid in an e-liquid tank to the atomizer or withdraws the e-liquid in the atomizer and a pipe to the e-liquid tank. Specifically, the e-liquid is added to an atomization part of the atomizer and then is heated by the control system so as to be atomized, wherein the real-time atomization temperature of the heating part of the atomizer is detected by the temperature detector, the detected real-time atomization temperature data is transmitted to the master controller of the control system, and the master controller acquires the real-time atomization temperature data and analyzes it in order to determine the required e-liquid feeding quantity or the e-liquid withdrawing quantity at the real-time atomization temperature.

Specifically, the master controller is used for comparing the real-time atomization temperature with a preset temperature threshold, wherein the preset temperature threshold may be understood as a standard temperature value, and under this standard temperature value, an electronic cigarette works in an optimal state so that the user obtains excellent taste. When the real-time atomization temperature is greater than the preset temperature threshold, it represents that the e-liquid supply quantity is insufficient, a control signal corresponding to e-liquid feeding is transmitted to the servo motor controller, and the servo motor controller controls the motor of the peristaltic pump to rotate in the forward direction so as to feed the e-liquid according to the e-liquid feeding quantity. Similarly, when the real-time atomization temperature is smaller than the preset temperature threshold, it represents that the e-liquid supply quantity is excessive, a control signal corresponding to e-liquid withdrawing is transmitted to the servo motor controller, and the servo motor controller controls the motor of the peristaltic pump to rotate in the reverse direction so as to withdraw the e-liquid according to the e-liquid withdrawing quantity. Exemplarily, the master controller may comprise a single chip microcomputer control unit, and in use, the user may set the power to change a temperature increase temperature and a temperature reduction temperature of the e-liquid so as to achieve the flow regulation of e-liquid transportation, thereby ensuring accurate control of the e-liquid transportation quantity (including the e-liquid feeding quantity and the e-liquid withdrawing quantity) at the atomizer.

It should be noted that, when the real-time atomization temperature is detected to be equal to the preset temperature threshold, it represents that the e-liquid supply quantity is sufficient, the servo motor controller stops working, correspondingly the peristaltic pump stops working and its pump body is locked, at this time, the e-liquid is not fed and withdrawn. Exemplarily, the preset temperature threshold may be a temperature value or a temperature range, and further may be set or regulated according to demands of different users, which is not limited herein.

Optionally, the system further comprises an e-liquid tank 130, wherein the e-liquid tank is separated from the heating part of the atomizer. Specifically, the e-liquid tank is designed to be separated from the heating part of the atomizer. However, in an e-liquid storage type atomizer in the prior art, an e-liquid storage part is connected with the heating part, and when the heating part works, it will directly cause the temperature of the e-liquid in the e-liquid tank to be increased, so the quality of the e-liquid is damaged and the taste is changed; additionally, the heating part of the conventional e-liquid storage type atomizer is connected with the e-liquid tank through an e-liquid conducting medium, and the e-liquid conducting medium is dipped in the e-liquid for a long time and is influenced by the working heating part so as to cause worse medium performance, e-liquid leaking, e-liquid splashing and bad user experience. In one specific example, the e-liquid conducting medium may be cotton. In the embodiment of the present disclosure, the e-liquid tank is designed to be separated from the heating part of the atomizer, and by comparing this design with the design of the e-liquid storage type atomizer, this design greatly achieves isolation of the e-liquid and the air, and solves the problems that the quality of the e-liquid is changed when the e-liquid and the air are contacted with each other for a long time, and the user experience is bad.

Optionally, the when the real-time atomization temperature is determined to be greater than a preset temperature threshold, the servo motor controller controls the motor of the peristaltic pump to rotate in the forward direction in order to feed an e-liquid according to the e-liquid feeding quantity specifically can be achieved in the following manner: when the real-time atomization temperature is determined to be greater than a preset temperature threshold, the servo motor controller controls a motor of the peristaltic pump to rotate in the forward direction at a first rotational speed in order to feed an e-liquid according to the e-liquid feeding quantity.

In one specific example, the first rotational speed can be determined according to the e-liquid feeding quantity, for example, a first corresponding relation of the e-liquid feeding quantity and the first rotational speed is stored in the system in advance, and the first corresponding relation may be positive correlation, that is, the greater the e-liquid feeding quantity is, the greater the first rotational speed is, so, the first rotational speed can be determined according to the first corresponding relation based on the e-liquid feeding quantity, and the motor is controlled to rotate in the forward direction at the first rotational speed in order to feed the e-liquid according to the e-liquid feeding quantity. Therefore, fast e-liquid feeding can be achieved when the e-liquid feeding quantity is relatively large.

Optionally, the when the real-time atomization temperature is determined to be smaller than the preset temperature threshold, the servo motor controller controls the motor of the peristaltic pump to rotate in the reverse direction in order to withdraw the e-liquid according to the e-liquid withdrawing quantity specifically can be achieved in the following manner: when the real-time atomization temperature is determined to be smaller than the preset temperature threshold, the servo motor controller controls the motor of the peristaltic pump to rotate in the reverse direction at a second rotational speed in order to withdraw the e-liquid according to the e-liquid withdrawing quantity.

In one specific example, the second rotational speed can be determined according to the e-liquid withdrawing quantity, for example, a second corresponding relation of the e-liquid withdrawing quantity and the second rotational speed is stored in the system in advance, and the second corresponding relation may be positive correlation, that is, the greater the e-liquid feeding quantity is, the greater the second rotational speed is, so, the second rotational speed can be determined according to the second corresponding relation based on the e-liquid withdrawing quantity, and the motor is controlled to rotate in the forward direction at the second rotational speed in order to withdraw the e-liquid according to the e-liquid withdrawing quantity. Thus, fast e-liquid withdrawing can be achieved when the e-liquid withdrawing quantity is relatively large.

It should be noted that the first rotational speed and the second rotational speed may be the same or different, the first corresponding relation and the second corresponding relation may be the same or different, and the first corresponding relation and the second corresponding relation can be set in the system according to habits of the user, which is only used for taking an example, but is not intended to limit herein.

By applying a peristaltic-pump e-liquid supplying manner of the automatic e-liquid transportation system of electronic cigarette in the embodiment of the present disclosure, the e-liquid of the e-liquid tank is accurately transported to the atomization part of the atomizer so as to achieve automation and avoid disadvantages of a tedious manually dropwise adding manner or a manually extruding manner; and due to the separation design of the e-liquid tank and the heating part, the problems of the e-liquid leaking, e-liquid splashing, repeated heating and the like are avoided. Furthermore, the peristaltic pump has a function of automatically locking an e-liquid transportation pipeline, so that the sealing property of the e-liquid tank may be greatly ensured, and the stable quality of the e-liquid is ensured.

In the embodiment of the present disclosure, in the control system, the temperature detector detects the real-time atomization temperature of the heating part of the atomizer, and the master controller determines the e-liquid feeding quantity or the e-liquid withdrawing quantity according to the real-time atomization temperature, thereby largely reducing manual e-liquid adding or extruding operations, and improving the accuracy of the e-liquid supplying process without wasting the e-liquid; the motor of the peristaltic pump is controlled to rotate in the forward direction or in the reverse direction by comparing the real-time atomization temperature with the preset temperature threshold in order to achieve e-liquid feeding or e-liquid withdrawing, thereby achieving automatic control on the e-liquid feeding or e-liquid withdrawing process; and the e-liquid feeding quantity and the e-liquid withdrawing quantity are accurately controlled, so that the completeness of the atomization process is ensured, no dry heating occurs, the taste is ensured when the user uses the electronic cigarette, and the user experience is improved.

Embodiment 2

Figure 2:
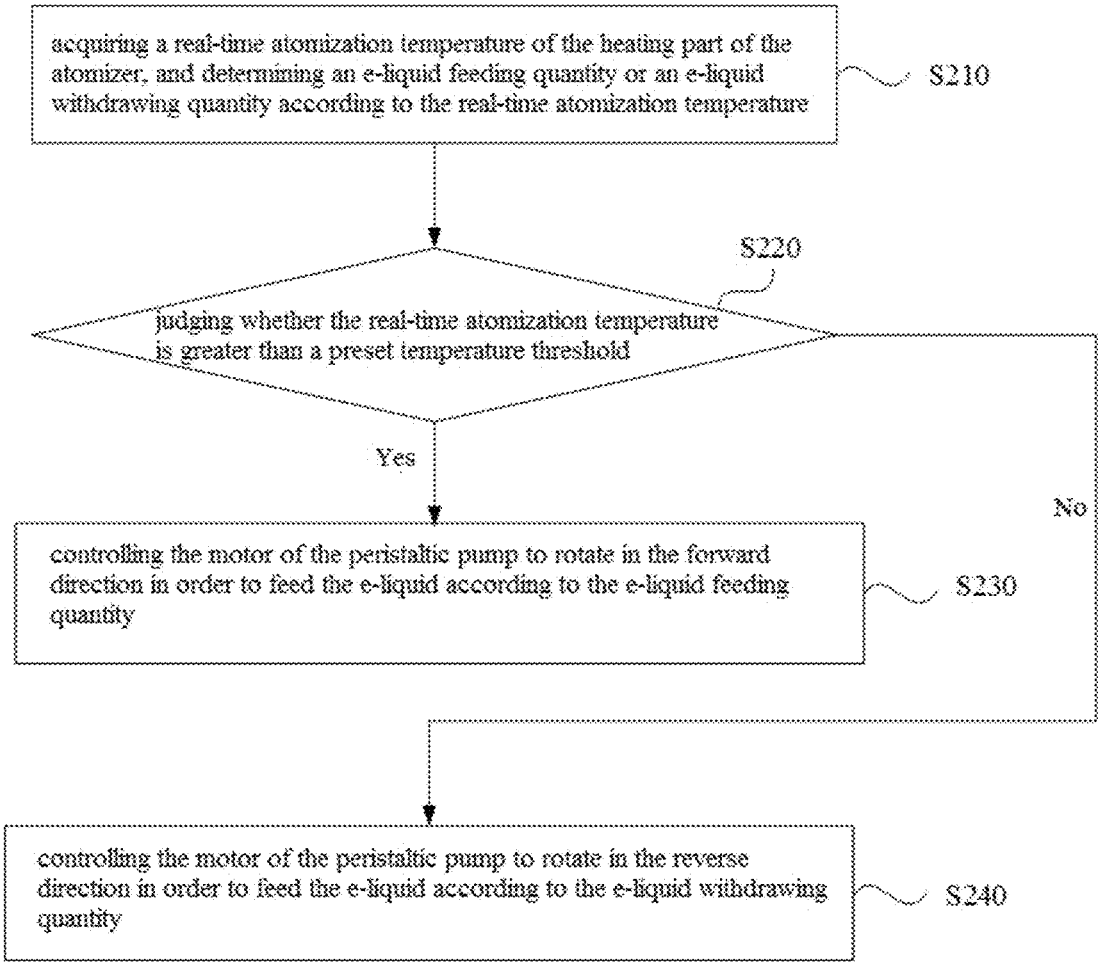
FIG. 2 is a flowchart of an automatic e-liquid transportation method of electronic cigarette, provided by embodiment 2 of the present disclosure.

FIG. 2 is a flowchart of an automatic e-liquid transportation method of electronic cigarette, provided by embodiment 2 of the present disclosure. The method is applied to the automatic e-liquid transportation system of electronic cigarette. Referring to FIG. 2, the method specifically may comprise the following steps:

S210, acquiring a real-time atomization temperature of the heating part of the atomizer, and determining an e-liquid feeding quantity or an e-liquid withdrawing quantity according to the real-time atomization temperature;

specifically, in the electronic cigarette normal working process, a real-time atomization temperature of the heating part of the atomizer is acquired and the real-time atomization temperature is analyzed in order to determine an e-liquid feeding quantity or an e-liquid withdrawing quantity at the current state, thereby indicating the peristaltic pump to feed or withdraw the e-liquid according to the e-liquid feeding quantity or the e-liquid withdrawing quantity;

S220, judging whether the real-time atomization temperature is greater than a preset temperature threshold; if yes, carrying out S230; otherwise, carrying out S240;

wherein the preset temperature threshold may be understood as a standard temperature value, and under this standard temperature value, an electronic cigarette works in an optimal state so that the user obtains excellent taste; the real-time atomization temperature is compared with the preset temperature threshold, when the real-time atomization temperature is greater than the preset temperature threshold, it represents that the e-liquid supply quantity is insufficient, a control signal corresponding to e-liquid feeding is transmitted to the servo motor controller, and S230 is carried out; and when the real-time atomization temperature is smaller than the preset temperature threshold, it represents that the e-liquid supply quantity is excessive, a control signal corresponding to e-liquid withdrawing is transmitted to the servo motor controller, and S240 is carried out;

S230, controlling the motor of the peristaltic pump to rotate in the forward direction in order to feed the e-liquid according to the e-liquid feeding quantity;

specifically, when the real-time atomization temperature is greater than the preset temperature threshold, it represents that the e-liquid supply quantity is insufficient, the control signal corresponding to the e-liquid feeding is transmitted to the servo motor controller, and the servo motor controller controls the motor of the peristaltic pump to rotate in the forward direction so as to feed the e-liquid according to the e-liquid feeding quantity;

S240, controlling the motor of the peristaltic pump to rotate in the reverse direction in order to withdraw the e-liquid according to the e-liquid withdrawing quantity;

similarly, when the real-time atomization temperature is smaller than the preset temperature threshold, it represents that the e-liquid supply quantity is excessive, the control signal corresponding to e-liquid withdrawing is transmitted to the servo motor controller, and the servo motor controller controls the motor of the peristaltic pump to rotate in the reverse direction so as to withdraw the e-liquid according to the e-liquid withdrawing quantity.

In the embodiment of the present disclosure, the real-time atomization temperature of the heating part of the atomizer is detected by the temperature detector in the control system, and according to the real-time atomization temperature, the master controller determines the e-liquid feeding quantity or the e-liquid withdrawing quantity, thereby improving the accuracy of the e-liquid supplying process; and the motor of the peristaltic pump is controlled to rotate in the forward direction or in the reverse direction by comparing the real-time atomization temperature with the preset real-time atomization temperature in order to achieve the e-liquid feeding or the e-liquid withdrawing, thereby achieving automatic control on the e-liquid feeding or e-liquid withdrawing process; and the e-liquid feeding quantity and the e-liquid withdrawing quantity are accurately controlled, so that the taste is ensured when the user uses the electronic cigarette, and the user experience is improved.

Optionally, the step of controlling the motor of the peristaltic pump to rotate in the forward direction in order to feed the e-liquid according to the e-liquid feeding quantity specifically can be achieved in the following manner: controlling the motor of the peristaltic pump to rotate in the forward direction at a first rotational speed in order to feed the e-liquid according to the e-liquid feeding quantity.

In one specific example, the first rotational speed can be determined according to the e-liquid feeding quantity, for example, a first corresponding relation of the e-liquid feeding quantity and the first rotational speed is stored in the system in advance, and the first corresponding relation may be positive correlation, that is, the greater the e-liquid feeding quantity is, the greater the first rotational speed is, so, the first rotational speed can be determined according to the first corresponding relation based on the e-liquid feeding quantity, and the motor is controlled to rotate in the forward direction at the first rotational speed in order to feed the e-liquid according to the e-liquid feeding quantity. Therefore, fast e-liquid feeding can be achieved when the e-liquid feeding quantity is relatively large.

Optionally, the controlling the motor of the peristaltic pump to rotate in the reverse direction in order to withdraw the e-liquid according to the e-liquid withdrawing quantity specifically can be achieved in the following manner: controlling the motor of the peristaltic pump to rotate in the reverse direction at a second rotational speed in order to withdraw the e-liquid according to the e-liquid withdrawing quantity.

In one specific example, the second rotational speed can be determined according to the e-liquid withdrawing quantity, for example, a second corresponding relation of the e-liquid withdrawing quantity and the second rotational speed is stored in the system in advance, and the second corresponding relation may be positive correlation, that is, the greater the e-liquid feeding quantity is, the greater the second rotational speed is, so, the second rotational speed can be determined according to the second corresponding relation based on the e-liquid withdrawing quantity, and the motor is controlled to rotate in the forward direction at the second rotational speed in order to withdraw the e-liquid according to the e-liquid withdrawing quantity. Thus, fast e-liquid withdrawing can be achieved when the e-liquid withdrawing quantity is relatively large.

It should be noted that the first rotational speed and the second rotational speed may be the same or different, the first corresponding relation and the second corresponding relation may be the same or different, and the first corresponding relation and the second corresponding relation can be set in the system according to habits of the user, which is only used for taking an example, but is not intended to limit herein.

Optionally, the operation of determining the e-liquid feeding quantity or the e-liquid withdrawing quantity according to the real-time atomization temperature specifically may be achieved by the following step: determining a target e-liquid quantity at the current real-time atomization temperature according to a corresponding relation of the atomization temperature and the e-liquid quantity; and comparing the current e-liquid quantity with the target e-liquid quantity so as to determining the e-liquid feeding quantity or the e-liquid withdrawing quantity.

Specifically, the control system stores the corresponding relation of the atomization temperature of the e-liquid and the e-liquid quantity in advance, wherein the e-liquid quantity specifically may be data stored in the form of a corresponding relation list, that is, the target e-liquid quantity corresponding to the current real-time atomization temperature may be determined by searching the corresponding relation list. Next, the e-liquid feeding quantity or the e-liquid withdrawing quantity may be determined by comparing the current e-liquid quantity at the current atomization temperature with the target e-liquid quantity. Accurate control on the e-liquid feeding quantity and the e-liquid withdrawing quantity ensures the completeness of the atomization process without dry heating.

Embodiment 3

Figure 3A:
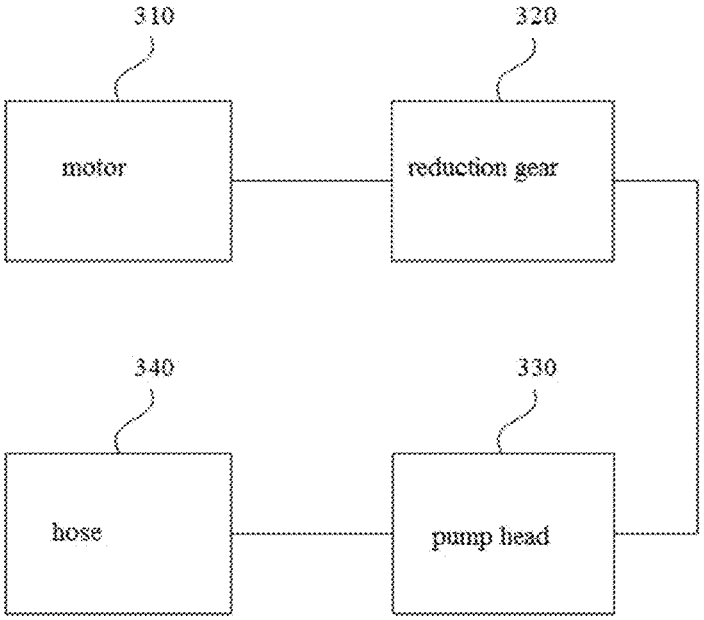
FIG. 3*a* is a structural block diagram of a peristaltic pump provided by embodiment 3 of the present disclosure.

FIG. 3*a* is a structural block diagram of a peristaltic pump provided by embodiment 3 of the present disclosure. As shown in FIG. 3*a*, the peristaltic pump specifically may comprise: a motor 310, a reduction gear 320, a pump head 330 and a hose 340.

The hose 340 is fixed by a stator and a rotor, and the hose 340 is used for connecting the e-liquid tank and the atomization part of the atomizer; and the motor 310 increases the torque by the reduction gear 320 in order to drive the pump head 330 to run, so rollers 331 in the pump head 330 alternatively extrude the hose 340 in order to achieve e-liquid feeding or e-liquid withdrawing.

Specifically, two ends of the hose extend from the bottom of the peristaltic pump, the hose in the embodiments of the present disclosure is an e-liquid transportation hose, the hose is used for connecting the e-liquid tank and the atomization part of the atomizer, one end of the hose is connected with the e-liquid tank while the other end is connected with the atomization part, a power source 370 connects the peristaltic pump with the control system through a power line, the servo motor controller achieves functions of e-liquid feeding and e-liquid withdrawing by controlling the motor of the peristaltic pump to rotate in the forward direction or in the reverse direction.

Optionally, the stator is a pump case 350, and the rotor is the rollers 331, wherein the hose is fixed by the stator and the rotor, the stator is the pump case, the rotor is the rollers, and the pump case can not only fix the hose, but also protect the peristaltic pump.

In the embodiments of the present disclosure, the peristaltic pump is utilized, and the e-liquid is completely transported through the e-liquid transportation hose, wherein the e-liquid transportation hose may be made of silica gel and is not in contact with the inner wall and the like of the pump body so as to ensure the cleanliness and sanitation of the e-liquid; furthermore, the motor drives the pump head to run through the reduction gear, and the hose is alternatively extruded by the rollers in the pump head in order to achieve the e-liquid feeding and the e-liquid withdrawing, so, the automation of the e-liquid feeding and e-liquid withdrawing processes is improved, the accuracy is higher, the taste of the user is ensured, and the user experience is improved.

Optionally, there is one, two or three rollers 331; correspondingly, when there are two rollers, the two rollers are arranged in a manner that an included angle of 180 degrees is formed between the two rollers, and when there are three rollers, the three rollers are arranged in a manner that an included angle of 120 degrees is formed between every two adjacent rollers.

Figure 3B:
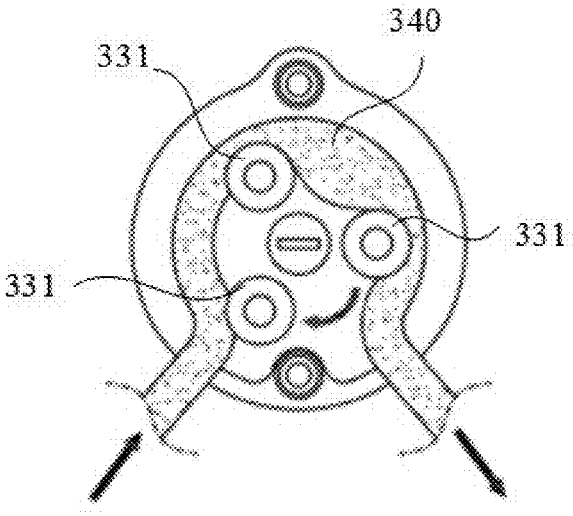
FIG. 3*b* is a sectional diagram of a pump head of the peristaltic pump in an e-liquid feeding process, applicable to embodiment 3 of the present disclosure.
Figure 3C:
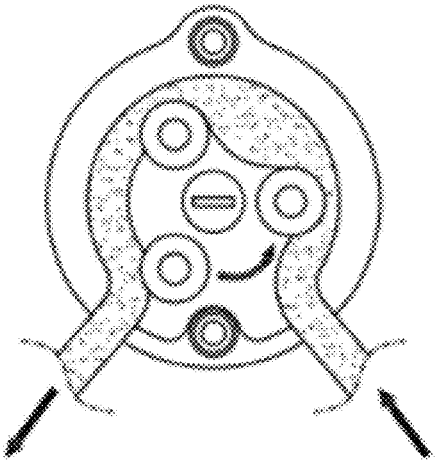
FIG. 3*c* is a sectional diagram of a pump head of the peristaltic pump in an e-liquid withdrawing process, applicable to embodiment 3 of the present disclosure.

FIG. 3*b* is a sectional diagram of a pump head of the peristaltic pump in an e-liquid feeding process, wherein by taking three rollers for an example, specifically, the pump head comprises three rollers 331 and a hose 340, and the direction of arrow represents the e-liquid feeding process. FIG. 3*c* is a sectional diagram of a pump head of the peristaltic pump in an e-liquid withdrawing process, specifically the pump head comprises three rollers 331 and a hose 340, and the direction of arrow represents the e-liquid withdrawing process. Optionally, the three rollers are arranged in a manner that an included angle of 120 degrees is formed between every two adjacent rollers so as to ensure the stability of roller fixation. It should be noted that other components of the peristaltic pump are not shown in FIG. 3*b* and FIG. 3*c*. It should be noted that FIG. 3*b* and FIG. 3*c* are merely used for giving a typical example, but not limiting to the number of the rollers, wherein the roller is directly arranged when there is one roller, and the rollers are arranged in a manner that an included angle of 180 degrees is formed between the two rollers when there are two rollers.

By combining with FIG. 3*b* and FIG. 3*c*, the following describes the working principle of the peristaltic pump in detail, wherein the motor, the reduction gear and the pump head are connected together to supply power for the pump head; optionally, the reduction gear may be a speed reducer, and the hose is clamped between the rotor and the stator. In the embodiments of the present disclosure, the motor is taken as a driver, the three rollers form the rotor, every two adjacent rollers have an included angle of 120 degrees, and the hose is clamped among the rollers and the pump case. When the motor starts working, the reduction gear increases the torque, the pump head is driven to run, the rollers in the pump head alternatively extrude the hose, the extruded fluid generates flow output, and a segment of the hose between two rollers restores its shape to form a pillow-shaped fluid after the pressure disappears, at this time, the volume is increased so vacuum generates, and the fluid is sucked, periodically the fluid is continuously sucked and flows out.

Optionally, the pump head 330 and the motor 310 are fixed by screws, so the firmness and the stabilization of the pump head and the motor are ensured.

Optionally, the pump head 330 comprises a pump body upper cover 332, locating pins 333, a supporting seat 334 and rollers 331, the rollers 331 sleeve the locating pins 333, and through holes for allowing the insertion of the rollers 331 are formed in the supporting seat 334. Specifically, the interiors of the rollers sleeve the locating pins, wherein the rollers sleeve the three locating pins in one-to-one correspondence, and combined bodies of the locating pins and the rollers are inserted into the through holes which are formed in the supporting seat and are used for allowing the insertion of the rollers.

Optionally, the peristaltic pump further comprises a pump case 360. The pump case is used for fixing and protecting the motor.

Optionally, the e-liquid feeding is achieved when the motor rotates in the forward direction, and the e-liquid withdrawing is achieved when the motor rotates in the reverse direction. Referring to FIG. 3*b*, when the motor rotates in the forward direction, the e-liquid is transported from left to right, so the e-liquid feeding function is achieved; and referring to FIG. 3*c*, when the motor rotates in the reverse direction, the e-liquid is transported from right to left, so the e-liquid withdrawing function is achieved.

Additionally, the peristaltic pump has a function of automatically locking the e-liquid transportation pipeline, so that the seal performance of the e-liquid tank may be greatly ensured, and the stable quality of the e-liquid is ensured.

Figure 3D:
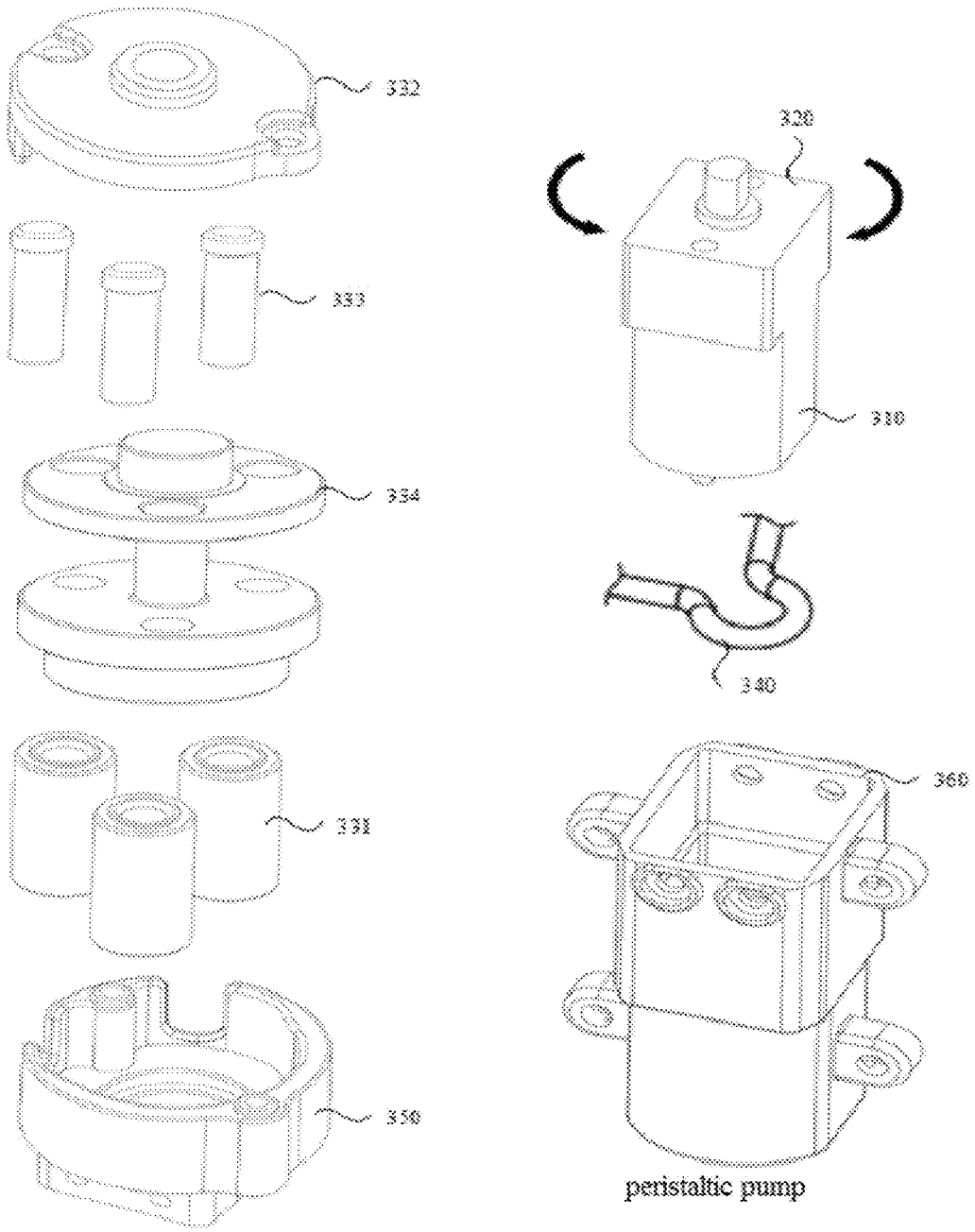
FIG. 3*d* is a schematic structural diagram of each component of the peristaltic pump applicable to embodiment 3 of the present disclosure.
Figure 3E:
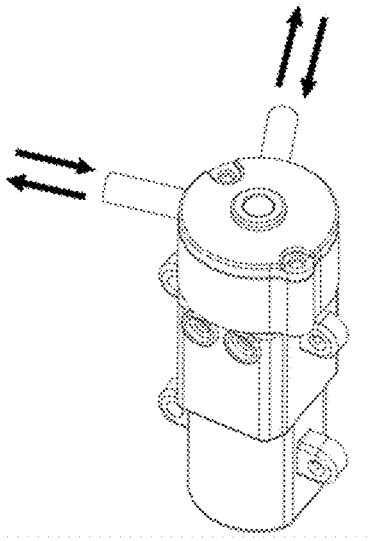
FIG. 3*e* is a schematic diagram of an overall structure of the peristaltic pump applicable to embodiment 3 of the present disclosure.

FIG. 3*d* is a schematic structural diagram of each component of the peristaltic pump. Referring to FIG. 3*d*, the pump head 330 comprises a pump body upper cover 332, locating pins 333, a supporting seat 334, rollers 331, a hose 340, a pump case 350, a reduction gear 320 (which specifically may be a speed reducer), a motor 310 and a motor housing 360, wherein the pump body upper cover 332, the locating pins 333, the supporting seat 334 and the rollers 331 are assembled to form the pump head, and the motor housing sleeves the motor. FIG. 3*e* is a schematic diagram of an overall structure of the peristaltic pump, wherein the directions of arrows may represent the directions of e-liquid feeding and e-liquid withdrawing. It should be noted that, as shown in FIG. 3*d*, three locating pins and three rollers are merely used for taking an example, which does not specifically limit to the number of the locating pins and the rollers.

Figure 3F:
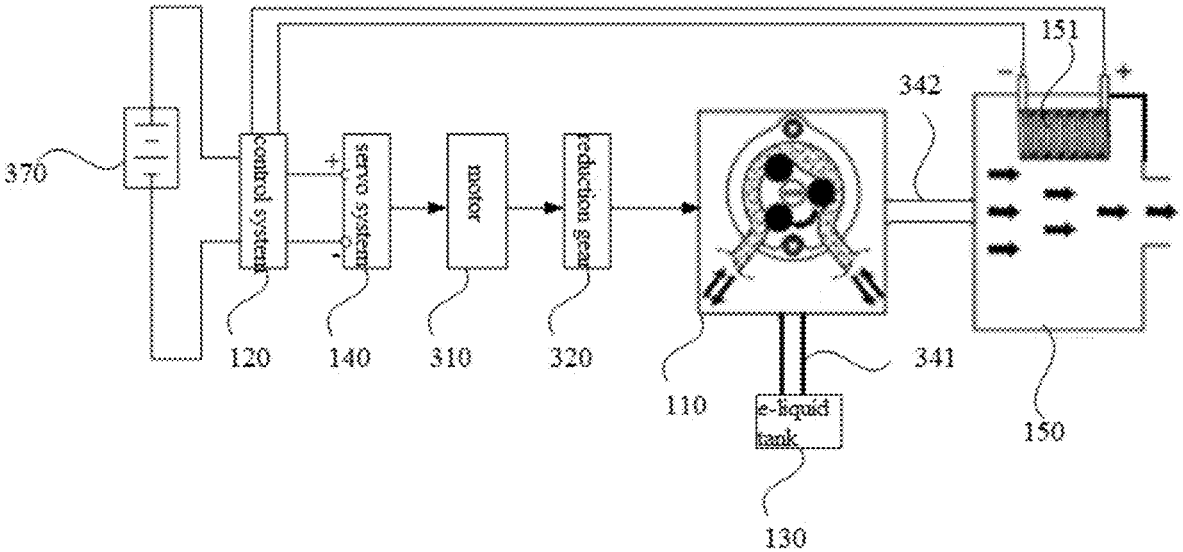
FIG. 3*f* is a schematic diagram of a working principle of an automatic e-liquid transportation system of electronic cigarette, applicable to embodiment 3 of the present disclosure.

FIG. 3*f* is a schematic diagram of a working principle of an automatic e-liquid transportation system of electronic cigarette, wherein 341 represents an e-liquid transportation hose 1 and is connected with the e-liquid tank, 342 represents an e-liquid transportation hose 2 and is connected with the atomizer, 151 represents the atomization part of the atomizer, and the arrow in the atomizer 150 represents that atomized e-liquid is discharged from a vapor outlet and is used for being inhaled by the user.

It should be understood that same or similar parts in each of the above embodiments may be referred to each other, and the contents without detailed description in some embodiments may refer to the same or similar contents in other embodiments.

It should be noted that in the descriptions of the present disclosure, the terms "first", "second" and the like are merely for the purpose of description, but should not be understood as indicating or implying relative importance. In addition, in the descriptions of the present disclosure, "a plurality of" means two or more unless otherwise indicated.

Any process or method described in the flowcharts or in other manners here may be understood as indicating a module, segment or portion of code including one or more executable instructions for implementing specific logic functions or process steps. The scope of preferred embodiments of the present disclosure includes additional implementations. It should be understood by those skilled in the art that the functions may occur in a sequence different from the sequences illustrated or discussed herein. For example, the functions may be executed, depending on the involved functionalities, substantially in parallel, or in a reverse sequence.

It should be understood that each of the parts of the present disclosure may be implemented by hardware, software, firmware or a combination thereof. In the above implementations, multiple steps or methods may be implemented by software or firmware that is stored in a memory and executed by an appropriate instruction executing system. For example, if it is implemented by hardware, it may be implemented by any of or a combination of the following technologies well known in the art as in another embodiment: a discrete logic circuit having a logic gate circuit for implementing a logic function for a data signal, an application-specific integrated circuit having an appropriate combined logic gate circuit, a programmable gate array (PGA), a field programmable gate array (FPGA), and the like.

Those of ordinary skill in the art may understand that implementation of all or some of steps in the method of the above embodiment may be completed by a program instructing relevant hardware. The program may be stored in a computer readable storage medium. When the program is run, one of or a combination of the steps of the method of the embodiment is performed.

In addition, functional units in the embodiments of the present disclosure may be integrated in one processing unit, or each of the units may exist alone physically, or two or more units may be integrated in one unit. The integrated unit may be implemented in the form of hardware or in the form of a software functional unit. When the integrated unit is implemented in the form of a software functional unit and sold or used as an independent product, the integrated unit may be stored in a computer readable storage medium.

The storage medium mentioned above may be a read-only memory (ROM), a magnetic disk, an optical disc, or the like.

Reference to phrases such as "an embodiment", "some embodiments", "an example", "a specific example", and "some examples" in the specification mean that specific features, structures, materials or characteristics described in combination with the embodiment(s) or example(s) are included in at least one embodiment or example of the present disclosure. In the specification, the schematic expressions of the phrases do not necessarily refer to the same embodiment or example. Moreover, the specific features, structures, materials or characteristics described may be combined in any suitable manner in one or more embodiments or examples.

Although the embodiments of the present disclosure have been illustrated and described, it should be understood that the above embodiments are exemplary and should not be construed as limitations to the present disclosure. Those of ordinary skill in the art may make changes, modifications, replacements and variations to the above embodiments without departing from the scope of the present disclosure.

What is claimed is:

1. An automatic e-liquid transportation system of electronic cigarette, characterized in that comprising a peristaltic pump and a control system, wherein:

the control system comprises a temperature detector, a servo motor controller and a master controller;

the temperature detector is used for detecting a real-time atomization temperature of a heating part of an atomizer and transmitting the real-time atomization temperature data to the master controller;

the master controller determines an e-liquid feeding quantity or an e-liquid withdrawing quantity according to the real-time atomization temperature;

when the real-time atomization temperature is determined to be greater than a preset temperature threshold, the servo motor controller controls a motor of the peristaltic pump to rotate in the forward direction in order to feed an e-liquid according to the e-liquid feeding quantity; and when the real-time atomization temperature is determined to be smaller than the preset temperature threshold, the servo motor controller controls the motor of the peristaltic pump to rotate in the reverse direction in order to withdraw the e-liquid according to the e-liquid withdrawing quantity.

2. The system according to claim 1, characterized in that further comprising an e-liquid tank, wherein the e-liquid tank is separated from the heating part of the atomizer.

3. The system according to claim 1, wherein the real-time atomization temperature is determined to be greater than the preset temperature threshold, the servo motor controller controls the motor of the peristaltic pump to rotate in the forward direction in order to feed the e-liquid according to the e-liquid feeding quantity when the real-time atomization temperature is determined to be greater than the preset temperature threshold, the servo motor controller controls the motor of the peristaltic pump to rotate in the forward direction at a first rotational speed in order to feed the e-liquid according to the e-liquid feeding quantity.

4. The system according to claim 3, characterized in that the when the real-time atomization temperature is determined to be smaller than the preset temperature threshold, the servo motor controller controls the motor of the peristaltic pump to rotate in the reverse direction in order to withdraw the e-liquid according to the e-liquid withdrawing quantity comprises:

when the real-time atomization temperature is determined to be smaller than the preset temperature threshold, the servo motor controller controls the motor of the peristaltic pump to rotate in the reverse direction at a second rotational speed in order to withdraw the e-liquid according to the e-liquid withdrawing quantity.

5. An automatic e-liquid transportation method of electronic cigarette, characterized in that the method is applied to the automatic e-liquid transportation system of electronic cigarette according to any one of the preceding claims, in which the method comprises:

acquiring the real-time atomization temperature of the heating part of the atomizer, and determining the e-liquid feeding quantity or the e-liquid withdrawing quantity according to the real-time atomization temperature;

judging whether the real-time atomization temperature is greater than the preset temperature threshold; if yes, controlling the motor of the peristaltic pump to rotate in the forward direction in order to feed the e-liquid according to the e-liquid feeding quantity;

if no, controlling the motor of the peristaltic pump to rotate in the reverse direction in order to withdraw the e-liquid according to the e-liquid withdrawing quantity.

6. The method according to claim 5, characterized in that the step of controlling the motor of the peristaltic pump to rotate in the forward direction in order to feed the e-liquid according to the e-liquid feeding quantity comprises:

controlling the motor of the peristaltic pump to rotate in the forward direction at a first rotational speed in order to feed the e-liquid according to the e-liquid feeding quantity.

7. The method according to claim 6, characterized in that the step of controlling the motor of the peristaltic pump to rotate in the reverse direction in order to withdraw the e-liquid according to the e-liquid withdrawing quantity comprises:

controlling the motor of the peristaltic pump to rotate in the reverse direction at a second rotational speed in order to withdraw the e-liquid according to the e-liquid withdrawing quantity.

8. The method according to claim 5, characterized in that the step of determining the e-liquid feeding quantity or the e-liquid withdrawing quantity according to the real-time atomization temperature comprises:

determining a target e-liquid quantity at the current real-time atomization temperature according to a corresponding relation of the atomization temperature and the e-liquid quantity; and comparing the current e-liquid quantity with the target e-liquid quantity so as to determining the e-liquid feeding quantity or the e-liquid withdrawing quantity.

* * * * *